US006262354B1

(12) United States Patent
Solomon, Jr.

(10) Patent No.: US 6,262,354 B1
(45) Date of Patent: Jul. 17, 2001

(54) PROTECTIVE GUARD AND PICK HOLDER FOR MUSICAL INSTRUMENTS

(76) Inventor: Collins Solomon, Jr., 1501 W. Hill Ave., Fullerton, CA (US) 92633

( * ) Notice: Subject to any disclaimer, the term of this patent is extended or adjusted under 35 U.S.C. 154(b) by 0 days.

(21) Appl. No.: 08/682,151

(22) Filed: Jul. 17, 1996

(51) Int. Cl.[7] ..... G10D 3/00
(52) U.S. Cl. ..... 84/329; 84/453
(58) Field of Search ..... 84/329, 297 S, 84/453; D17/20

(56) References Cited

U.S. PATENT DOCUMENTS

| | | | | |
|---|---|---|---|---|
| 3,251,258 | | 5/1966 | Parker | 84/453 |
| 3,877,501 | | 4/1975 | Toth | 150/52 |
| 4,135,431 | * | 1/1979 | Ferguson | 84/329 |
| 4,528,889 | * | 7/1985 | Gentile, Jr. | 84/453 |
| 4,601,391 | | 7/1986 | Gibbs et al. | 206/315 |
| 5,103,709 | | 4/1992 | Foss | 84/327 |

* cited by examiner

*Primary Examiner*—William M. Shoop, Jr.
*Assistant Examiner*—Shih-yung Hsieh

(57) ABSTRACT

The present invention provides a unique device for protecting the strings of musical instruments such as guitars and stringed bases in the event they should topple over face down. The device also serves to clean and buff the strings of musical instruments while at the same time providing a pocket 14 and 15 for pick storage. The present invention is a pad 12 of soft cloth or pre-formed soft rubber which when attached to the strings of musical instruments will not scratch and damage the instruments delicate finish. A groove 13 bottom side enables a secure fit over and around string 11*a* through 11*f*. It also allows for easy attachment and detachment of pad 12.

4 Claims, 4 Drawing Sheets

PROTECTIVE GUARD AND PICK HOLDER FOR MUSICAL INSTRUMENTS

BACKGROUND OF THE INVENTION

1. Field of the Invention

This invention relates to a guard to protect the strings of articles such as musical instruments. More particularly, it relates to a guard of the pad type.

2. Description of the Prior Art

Musical instruments such as guitars and bases have strings that generally experience wear and tear over time. Strings of musical instruments lose their sheen, stretch and deteriorate through an ordinary aging process. A premature aging effect takes place when the strings' surface contacts the surface of that of wooden floors, concrete surfaces and the like. Another cause of premature aging of the strings of musical instruments is pick insertion. Pick insertion is the act of musicians wedging picks between the strings of musical instruments for easy accessibility. This act compounds the natural stretching tendency of strings and decreases the resonance acceptability. Eventually strings break. Dirt and moisture are two more reasons for premature aging of strings of musical instruments. Dirt and moisture cause loss of sheen and rust build up on the strings of musical instruments. All these factors may cause serious damage to the strings of musical instruments and may warrant costly string replacement.

It is an object of the present invention to provide,

1. A method of periodic buffing and cleaning of strings of musical instruments such as guitars, bases and the like,
2. A protective pad for the strings of stringed instruments such as guitars, bases and the like,
3. A protective article that is inexpensive, easy to install, detachable, and universal in fit,
4. It is a further object of this invention to provide a proper storage compartment for picks that are accessories used to play musical instruments such as guitars, bases and the like.

These and other objects that will be apparent hereinafter provided by a protective pad having An underside that enables the clamping on to, over and around the strings of musical instruments. Clean and buff the strings by dragging the pad the entire length of the strings. Detach the pad by releasing its edges from the two outer most strings. The topside of a pad has impressions of picks for convenient multiple pick storage.

DESCRIPTION OF THE PREFERRED EMBODIMENT

Figure 1:
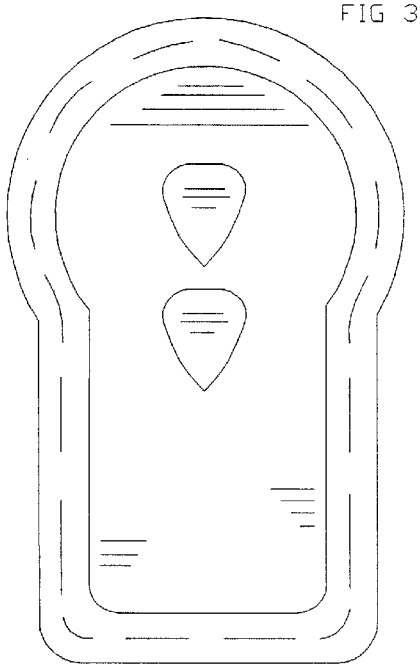
FIG. 1 is a top plan view of a protective pad.
Figure 1A:
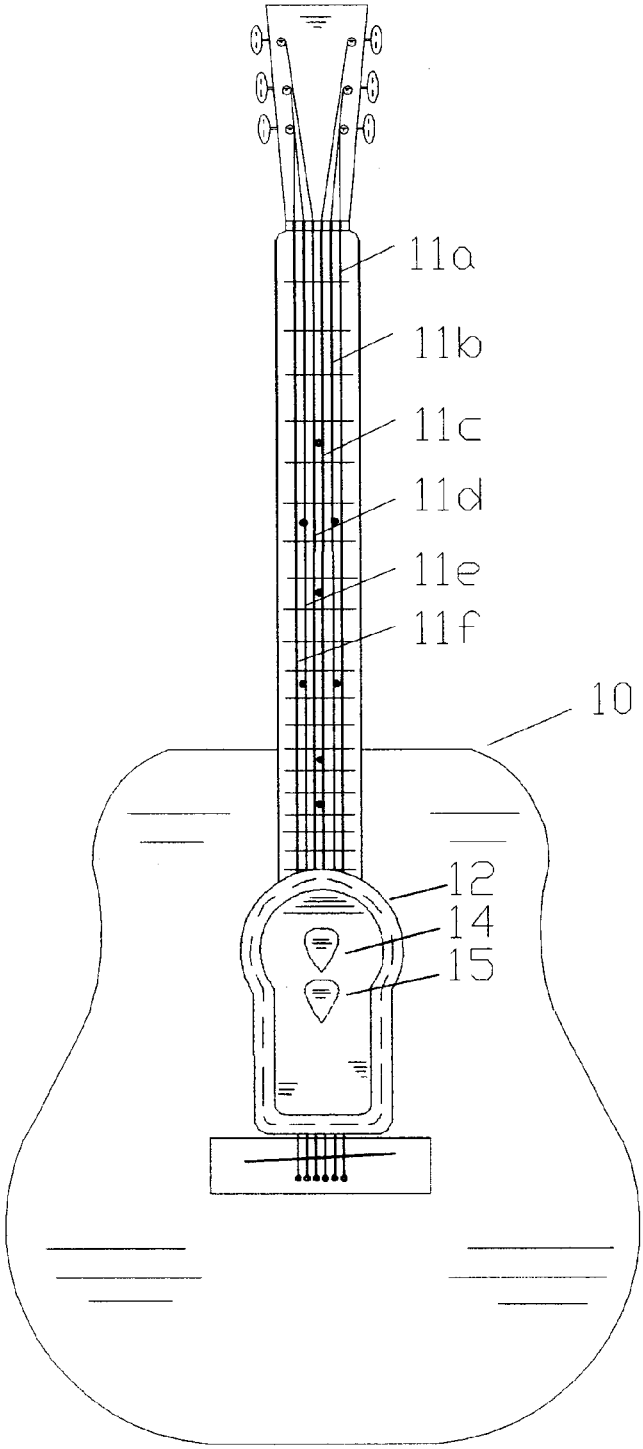
FIG. 1A is a top plan view of a protective pad attached to a guitar.
Figure 2A:
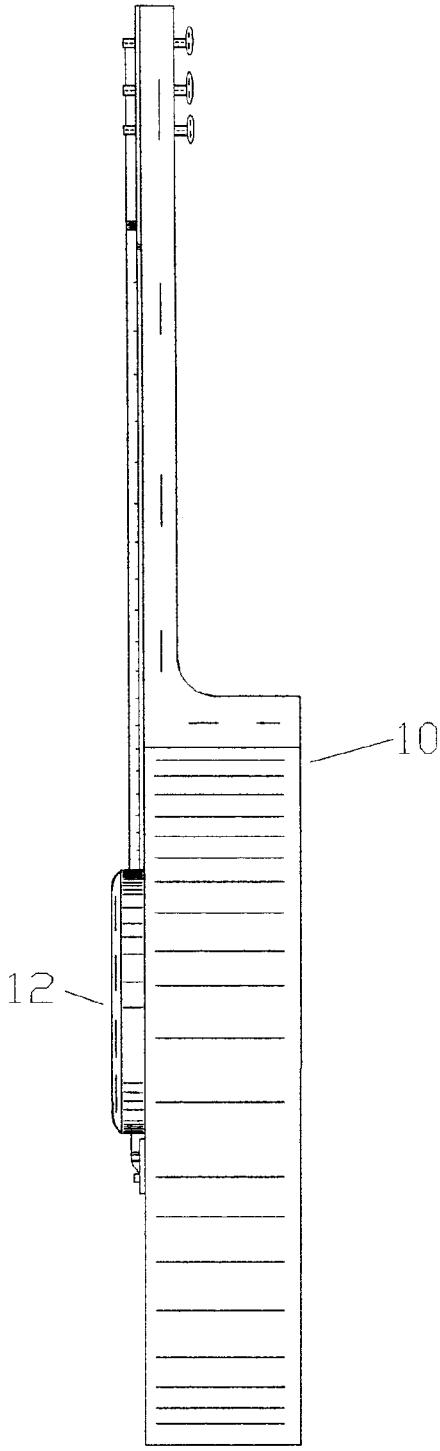
FIG. 2A is a left side view of a protective pad attached to a guitar.

Referring to FIG. 1A, a guitar 10 showing, pad 12 partially covering the entire length of string 11*a* through 11*f*.

As seen in FIG. 1A, a pad 12 shaped partly oval and partly rectangular for easy handling. It is a one piece construction of a compressible material such as foam sponge rubber or the like.

Figure 3:
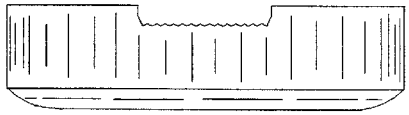
FIG. 3 is a front view of a protective pad.
Figure 6:
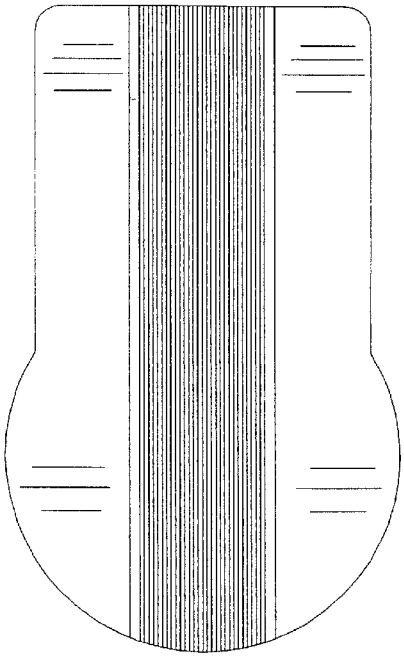
FIG. 6 is a plan bottom view of a protective pad.
Figure 7:
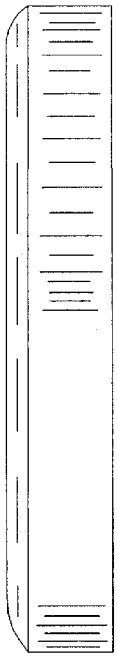
FIG. 7 is a right side view of a protective pad.
Figure 2:
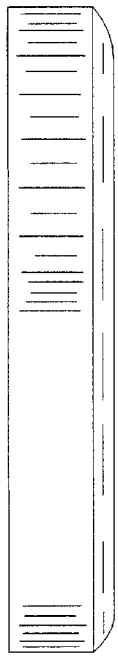
FIG. 2 is a left side view of a perspective pad.
Figure 8:
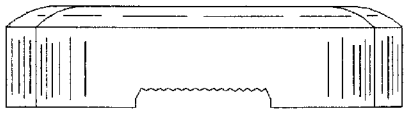
FIG. 8 is a rear view of a protective pad.
Figure 4:
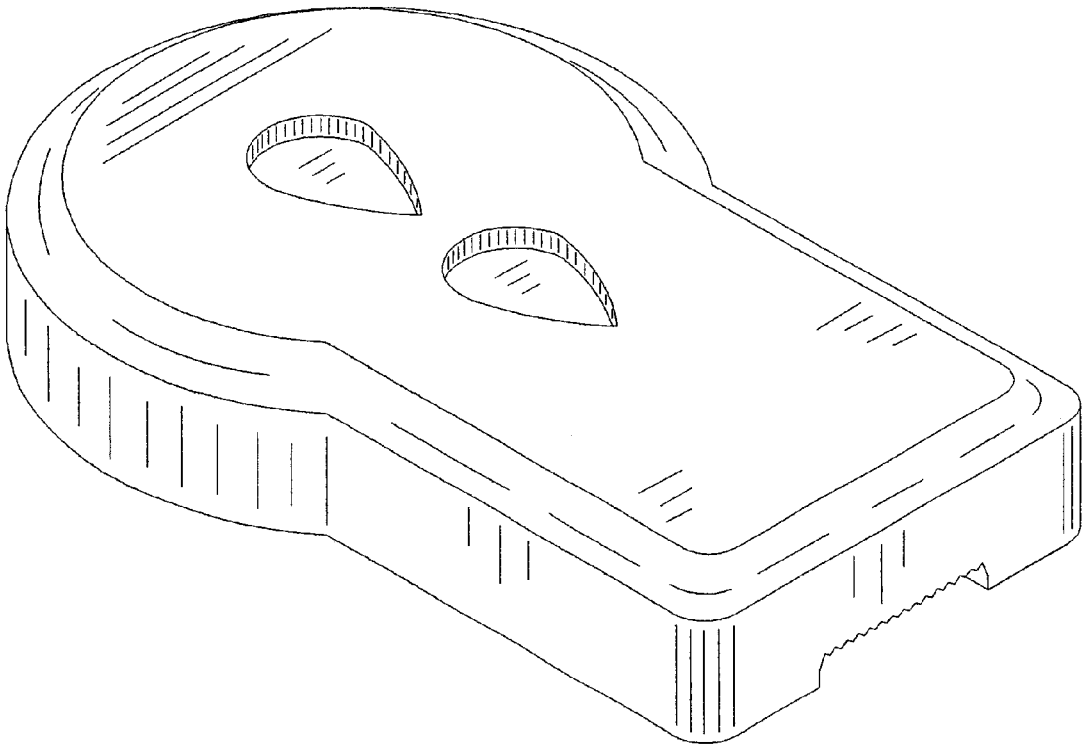
FIG. 4 is top perspective view of a protective pad with indentations for pick storage.
Figure 5:
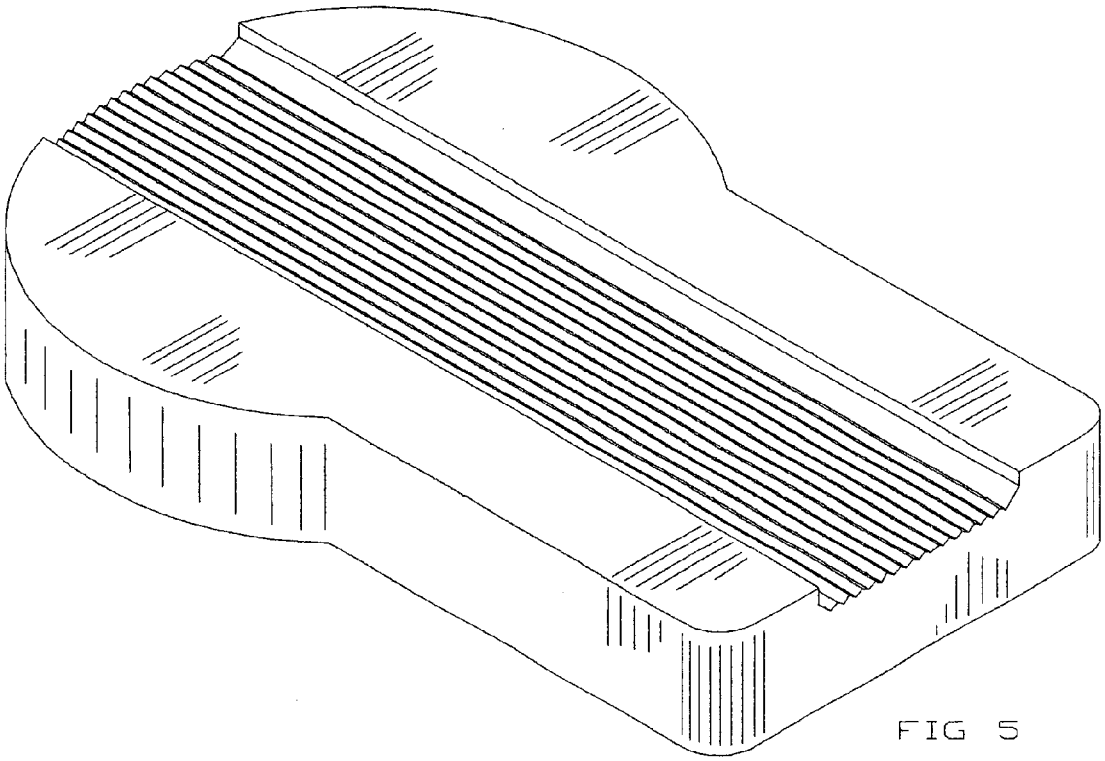
FIG. 5 is a bottom perspective view of a protective pad.

Referring to FIG. 5, cut out groove 13. Groove 13 enables the clamping on to and around the edges of string 11*a* through string 11*f* of guitar 10;

FIG. 4 illustrates indentations for pick storage;

FIG. 6 illustrates the plan bottom view of pad 12; and

To initially attach pad 12, press it against string 11*a* through 11*f*. Obtain a secure fit in groove 13. Thereafter, pad 12 detaches by peeling back one edge to separate it from string 11*a* through 11*f*. Drag pad 12 the entire length of guitar 10 for cleaning purposes while still attached.

What is claimed is:

1. A protective pad is for strings of musical instruments such as guitars and bases comprising:

a) a removable pad attached to said strings of a musical instrument in an area of a fret and or bridge hole,
   i) an underside groove cut out for string attachment,
   ii) a multiple pick impression top surface.

2. The protective pad in claim 1, and mean for cleaning the strings of said musical instruments.

3. The protective pad in claim 1, and mean for buffing said strings.

4. The protective pad in claim 1, and mean for storing multiple picks used for strumming said strings.

* * * * *